United States Patent [19]

Rhodes

[11] Patent Number: 5,033,589

[45] Date of Patent: Jul. 23, 1991

[54] ROLLER GUIDE WHEEL ASSEMBLY WITH IMPROVED REPLACEABLE TIRE

[75] Inventor: Norman D. Rhodes, Pasadena, Tex.

[73] Assignee: Houston Manufacturing & Specialty Company, Inc., Houston, Tex.

[21] Appl. No.: 416,249

[22] Filed: Oct. 2, 1989

[51] Int. Cl.[5] ..... B66B 7/02

[52] U.S. Cl. ..... 187/95; 29/892.1; 384/33

[58] Field of Search ..... 187/95, 9 R, 9 E, 1 R; 104/242, 245; 29/402.01, 402.03, 402.08, 757, 898.01, 469, 892.1, 892; 384/33, 59

[56] References Cited

U.S. PATENT DOCUMENTS

| | | | |
|---|---|---|---|
| 751,715 | 2/1904 | Butler | 29/898.01 |
| 2,100,169 | 11/1937 | Morton | 187/95 |
| 4,254,541 | 3/1981 | St. John | 29/892.1 |

FOREIGN PATENT DOCUMENTS

| | | | |
|---|---|---|---|
| 1065324 | 11/1984 | U.S.S.R. | 187/95 |

*Primary Examiner*—Robert P. Olszewski
*Assistant Examiner*—Kenneth Noland
*Attorney, Agent, or Firm*—Harrison & Egbert

[57] ABSTRACT

An apparatus and method for conveniently servicing an elevator roller guide wheel assembly by replacing the tires thereof is provided. The preferred embodiment of the present invention comprises a three-component removable roller guide tire assembly in which the removable tire portion is interconnected with a hub plate portion. A flange plate portion is then interconnected with the joinder of the said tire and hub plate portions of the assembly. The roller guide tire assembly is comprised preferably of a dual durometer matrix of polyurethane to provide the necessary wear and pressure resistance properties thereof. Each of these three plate portions is molded with a metal plate to sustain the requisite dimensions and tolerances of the apparatus. In accordance with the present invention, when usual repair and replacement of a tire in an elevator roller guide assembly is required, only the tire is replaced instead of the entire wheel assembly.

5 Claims, 3 Drawing Sheets

ROLLER GUIDE WHEEL ASSEMBLY WITH IMPROVED REPLACEABLE TIRE

BACKGROUND OF THE INVENTION

This invention relates to servicing of elevators, and more particularly relates to apparatus and methods for servicing an elevator roller guide wheel assembly by replacing the tires thereof.

It is well known in the prior art that an elevator car travels vertically in hoistways using a pair of parallel T-shaped guide rails. It is also well known in the prior art that the travel of an elevator car is effectuated by the cooperation between the T-shaped guide rails and roller guides which are affixed on each of the four sides thereof, proximal to its top and bottom portions.

More particularly, in U.S. Pat. No. 3,087,583, Bruns describes the operation of rolling wheel type guides which are resiliently mounted on an elevator car and which cooperate with three guiding surfaces of each rail, thereby controlling the travel of the elevator car. The wheels are mounted on axles which enable the rim thereof to move on the guide rail surface, while being biased into contact with this surface by a plurality of springs. These roller guides include a pedestal to maintain contact between the guide assembly and the elevator car.

Bruns further describes the limitations of the prior art whereby misalignment of guide rails may cause a car's travel to deviate from its intended path. This, in turn, may cause swaying of the car while traversing the hoistway and produce concomitant forces upon the roller guide wheels. Accordingly, Bruns teaches an extended roller guide which inherently mitigates the impact of guide rail discontinuities by cushioning roller travel.

Similarly, Tucker, in U.S. Pat. No. 3,099,334 discloses an improved elevator roller guide for minimizing perturbations to the preferred position of elevator cars on their respective guide rail surfaces. By avoiding this hereinbefore described tendency of an elevator car to sway as it traverses the hoistway, particularly at high speeds, the associated noises are reduce. Unfortunately, the conventional method of increasing the pressure of a roller guide against the surface of the guide rails also increases noise. Accordingly, the Tucker improved roller guide provides only minimal pressure against the respective guide rail surfaces and also provides dampening means to reduce the tendency of a car to sway.

Another limitation known in the prior art is the interdependence between imbalance and misalignment in the rollers comprising a roller guide assembly. In particular, as described in U.S. Pat. No. 3,329,240, in spite of careful alignment of roller guides with T-shape guide rails, misalignment of side rollers is effectuated as a consequence of there being an imbalance causing deflection of face rollers. Conversely, an imbalance causing a deflection of side rollers, effectuates a misalignment of face rollers. In U.S. Pat. No. 3,329,240, Harwood discloses an improved roller guide assembly which avoids the hereinbefore described misalignment of face and side rollers with respect to corresponding guide rail surfaces, notwithstanding there being an imbalance in an elevator car, or there being misalignment or deflection in the guide rails. More particularly, the Harwood roller guide comprises a rigid roller mounting cage having a face roller receiving portion and a side roller mounting portion. Six rollers are rotatably mounted on the cage, with the cage having flexible loading means which is adapted to preload the face rollers against the face roller contact portion of the guide rail.

Elevator wheels typically consist of a metal housing which contains its rolling surface and retained wheel bearings. The rolling surface or "tire" is conventionally made from malleable materials like rubber or polyurethane. It is well known to those skilled in the art that the common reason for roller guide failure is bond separation between the metal hub of a wheel and the tire. Such bond separation causes the tire to break away from the roller guide assembly, thereby interfering with the normal travel of an elevator car as it proceeds vertically up and down the hoistway.

It is apparent to those skilled in the art that the usual remedy for a broken roller guide wheel is to remove and replace the entire wheel assembly. Such an assembly conventionally consists of a metal hub with a tire bonded thereto, and ball bearings contained in a concentric retainer ring. Depending upon the manufacturer, sometimes the repair also includes a replacement shaft. For example, servicing a damaged roller guide for an Otis Elevator typically includes replacement of the shaft.

It is a disadvantage of the prior art that notwithstanding that such roller guide failures are usually not caused by bearing failures, during the servicing of a roller guide wheel, the existing bearings are conventionally discarded. It is also a disadvantage of the prior art that repairing a roller guide wheel with a separated tire necessitates replacing the entire wheel assembly instead of merely replacing the tire thereof.

Accordingly, these limitations and disadvantages of the prior art have been overcome with the present invention, and improved apparatus and techniques are provided which are especially useful for servicing an elevator roller guide wheel assembly, and for the replacement of the tire thereof.

SUMMARY OF INVENTION

The present invention provides an apparatus and method for conveniently servicing an elevator roller guide wheel assembly by replacing the tires thereof. The preferred embodiment of the present invention comprises a three-component removable roller guide tire assembly in which the removable tire portion is interconnected with a hub plate portion. A flange plate portion is then interconnected with the joinder of the said tire and hub plate portions of the assembly.

The roller guide tire assembly is comprised preferably of a dual durometer matrix of polyurethane to provide the necessary wear and pressure resistance properties thereof. Each of these three plate portions is molded with a metal plate to sustain the requisite dimensions and tolerances of the apparatus. An alignment mechanism is provided to enable the tire to be readily removed and replaced.

Accordingly, it is a feature of the present invention that the tires of a conventional roller guide assembly may be conveniently replaced without having to replace the entire wheel assembly.

It is an object and feature of the present invention to provide an apparatus and method for expeditiously replacing the tire of a conventional roller guide assembly, with only minimal elevator downtime.

It is also an object of the present invention to provide a method to quickly and safely replace the tires of conventional roller guide assembly.

It is a further object of the present invention to provide an improved roller guide wheel assembly which is not susceptible to failure due to bond separation.

It is a further object of the present invention to provide a method to repair elevators with minimal inconvenience to the riders thereof.

It is a specific object of the present invention to provide, in a roller guide assembly with a shaft for moving an elevator car vertically in a hoistway along a pair of T-shaped guide rails, a wheel assembly comprising flange plate means; tire plate means engaging the surfaces of said T-shaped guide rails and adapted to receive said flange plate means; hub plate means rotatably engaging said shaft and adapted to receive said tire plate means; alignment means, disposed adjacent the proximal surfaces of said flange plate means and said tire plate means, and adjacent the proximal surfaces of said tire plate means and said hub plate means, for controlling said receiving of said flange plate means by said tire plate means and for controlling said receiving of said tire plate means by said hub plate means; and securing means for attaching said flange plate means to said tire plate means and for attaching said tire plate means to said hub plate means.

It is also a specific object of the present invention to provide a method of replacing the tire plate in a roller guide wheel assembly, including a flange plate, a hub plate and a shaft, with a new tire plate, for moving an elevator car vertically in a hoistway along a pair of T-shaped guide rails, comprising the steps of disengaging a securement member attaching said flange plate and said tire plate; removing said flange plate from said tire plate; disengaging said securement member attaching said tire plate and said flange plate; removing said tire plate from said hub plate; aligning said new tire plate with said hub plate; engaging said new tire plate with said hub plate; aligning said flange plate with said new tire plate; and engaging said flange plate with said new tire plate.

These and other objects and features of the present invention will become apparent from the following detailed description, wherein reference is made to the figures in the accompanying drawings.

IN THE DRAWINGS

DETAILED DESCRIPTION

Figure 1:
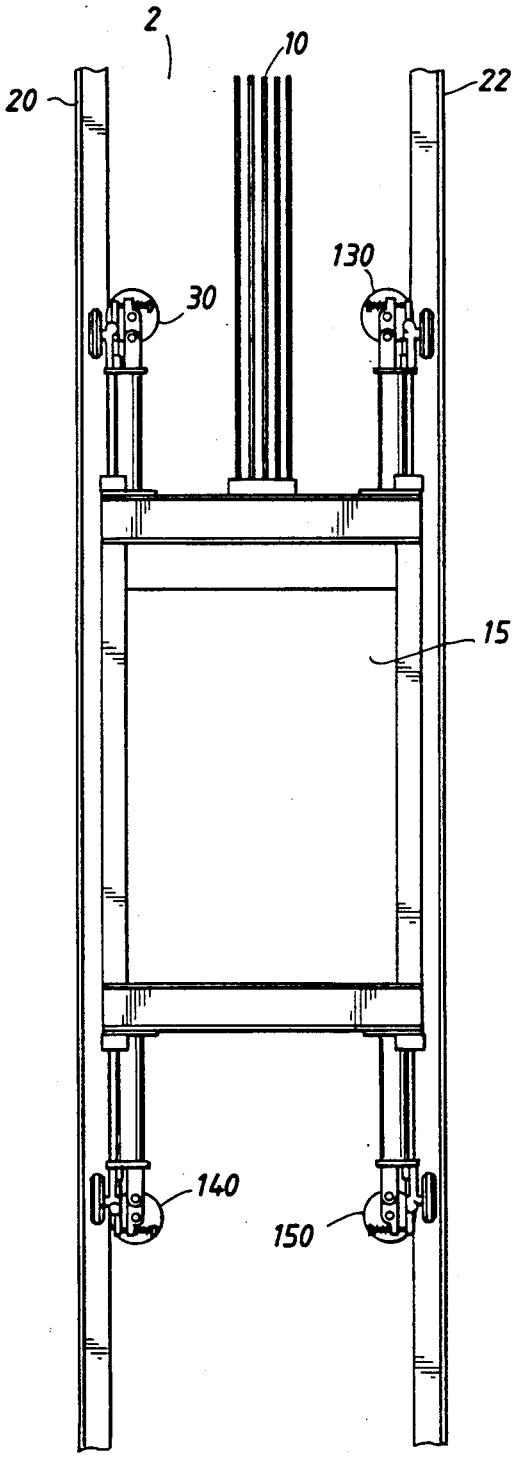
FIG. 1 is a front view of a hoistway containing an elevator car which travels along vertical T-shaped rails on roller guide assemblies embodying the present invention.

Referring to FIG. 1, there may be seen a front view of elevator hoistway 2 with elevator car 15 which travels along vertical T-shaped rails 20 and 22 on roller guide assemblies 30 and 130 on the top portion of oar 15, and roller guide assemblies 140 and 150 on the bottom portion of car 15, which embody the present invention. Also shown are cables 10 for moving said elevator car 15 vertically in said hoistway 2.

Figure 2:
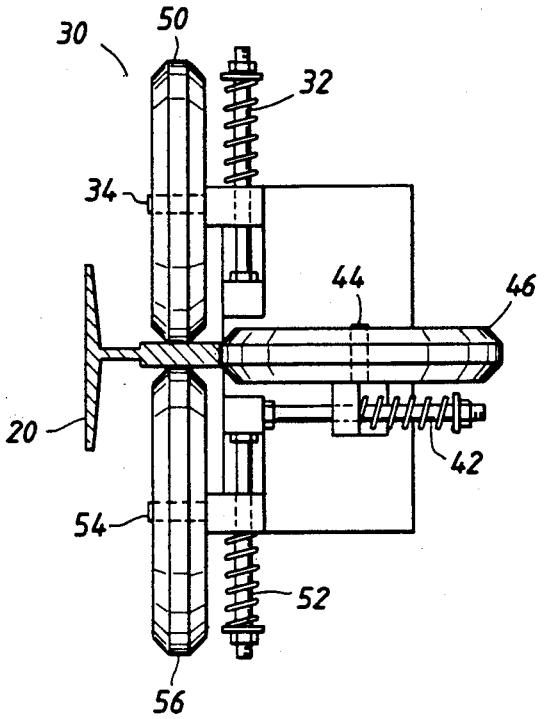
FIG. 2 is an enlarged top view of the roller guide assembly depicted in the upper left portion of FIG. 1.
Figure 3:
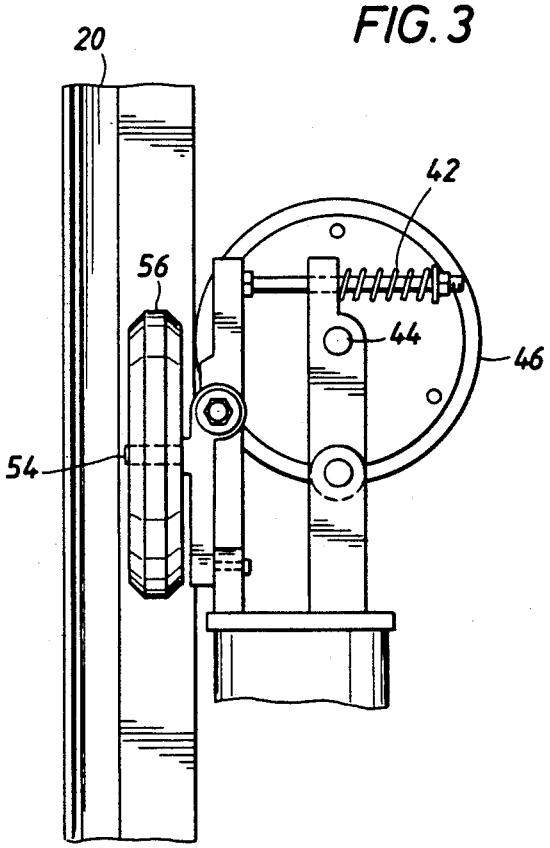
FIG. 3 is an enlarged top view of the roller guide assembly depicted in the upper left portion of FIG. 1.

Now referring to FIGS. 2 and 3, there may be seen enlarged views of roller guide assembly 30 depicted FIG. 1. As is well known in the prior art, roller guide tire assemblies 46, 50, and 56 rollably engage adjacent surfaces of T-shaped rail 20. Roller guide tire assembly 50 is removably attached to roller guide assembly 30 by mounting shaft 34, and is maintained in its position by spring 32. Similarly, roller guide tire assembly 46 is removably attached to roller guide assembly 30 by mounting shaft 44, and is maintained in its position by spring 42. Similarly, roller guide tire assembly 56 is removable attached to roller guide assembly 30 by mounting shaft 54, and is maintained in its position by spring 52. As should be apparent to those skilled in the art, these springs bias the tire assembly against its corresponding guide rail surface, thereby promoting the continual contact therebetween, with minimal sway of elevator car 15 and minimal noise.

Figure 4:
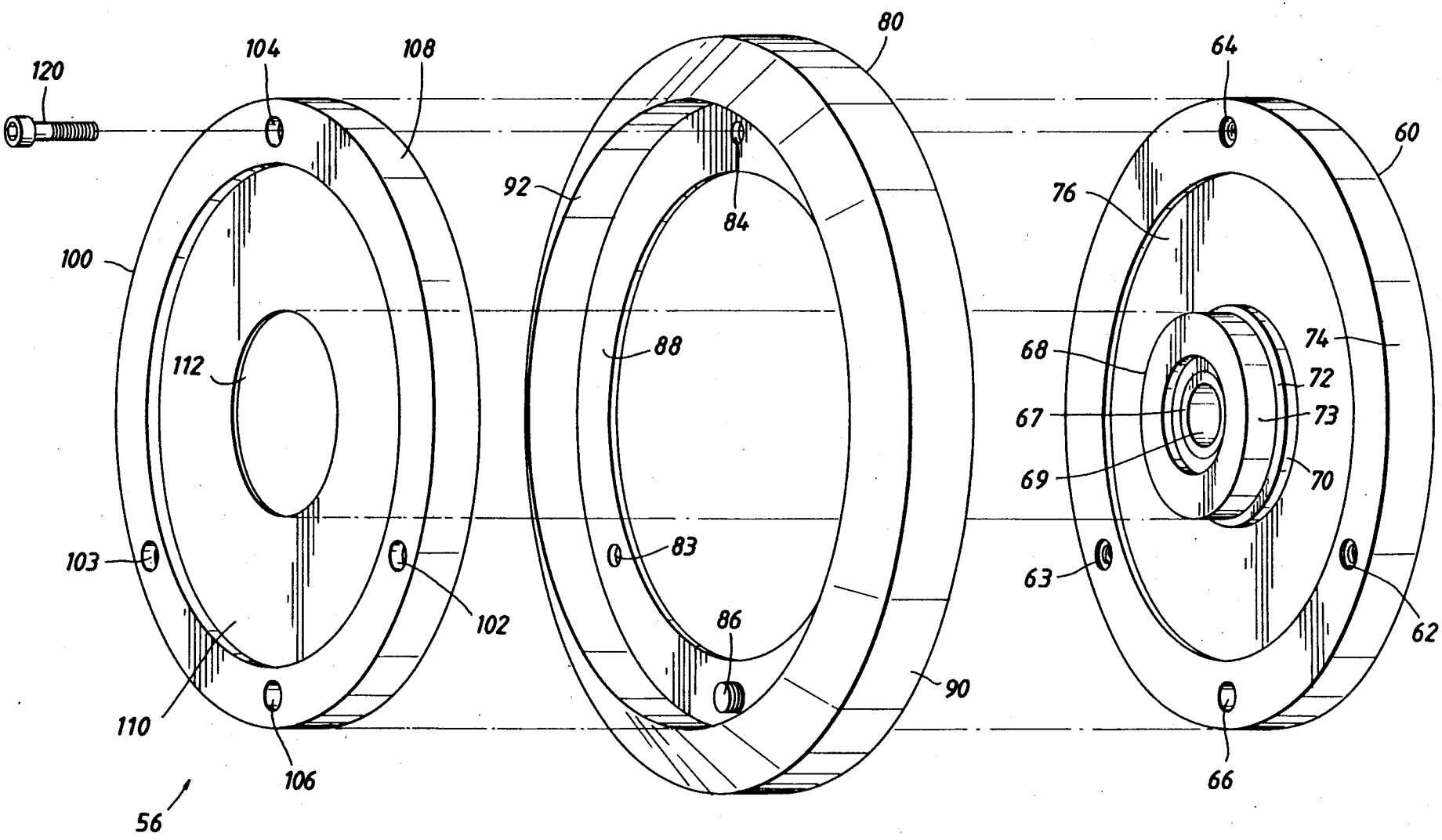
FIG. 4 is a front perspective view of the unassembled roller guide tire assembly embodying the present invention.

Now referring to FIG. 4, there may be seen a front perspective view of the disengaged roller guide tire assembly embodying the present invention. In particular, roller guide tire assembly 56 comprises hub plate portion 60, removable tire plate portion 80, and flange plate portion 100. Hub plate portion 60 is depicted with metal plate 76 molded into preferably polyurethane rim 74. Bearing housing 68 concentrically contains bearing retainer 67. Also depicted is housing 70, ledge 72 and central aperture 69. Screw apertures 62, 63 and 64 are preferably 120 degrees apart and cooperate with tire plate portion 80 and flange plate portion 100 to enable roller guide tire assembly 56 to be securely assembled. Alignment aperture 66, as will be hereinafter described in detail, enables the three portions of the roller guide tire assembly to be expeditiously interconnected.

Still referring to FIG. 4, in accordance with the present invention, removable tire plate portion 80 is depicted with metal plate 88 and preferably polyurethane rim 90. More particularly, annular metal plate 88 is partially imbedded into the middle of the wall of said rim 90 by being fixedly molded thereto. Thus, metal plate 88 divides said wall into upper portion 92 and lower portion 93 (not shown). Screw apertures 82 (not shown), 83 and 84 are preferably 120 degrees apart and cooperate with corresponding screw apertures 82, 83 and 84. Threaded alignment pin 86 engages alignment aperture 66 of hub plate 60 and alignment aperture 106 of flange plate 100, to enable these three portions of the roller guide tire assembly to be easily and quickly interconnected. Alignment pin 86 is threaded to maintain its position in encapsulated plate 80.

Again referring to FIG. 4, flange plate portion 100, is depicted with metal plate 110, axial aperture 112 and rim portion 108. Screw apertures 102, 103 and 104 are preferably 120 degrees apart and cooperate with corresponding screw apertures 82, 83 and 84, and alignment pin 86 as hereinbefore described in detail. Securement member 120, preferably a bolt or the like, is depicted as engaging screw apertures 104, 84 and 64 to secure the flange plate 100 to the tire portion 80, in turn, to the hub plate portion 60. A similar securement member is inserted into screw apertures 103, 83 and 63; and into screw apertures 102, 82 and 62.

Thus, bearing housing 68 of hub plate 60 receives corresponding axial aperture 112 of flange plate 100 by said axial aperture 112 being matched in dimension with shoulder 73 of hub plate 60. When attached to hub plate 60 by the cooperation of alignment pin 86 and alignment apertures 66 and 106, said axial aperture 112 rests upon ledge 72 of hub plate 60.

Figure 6:
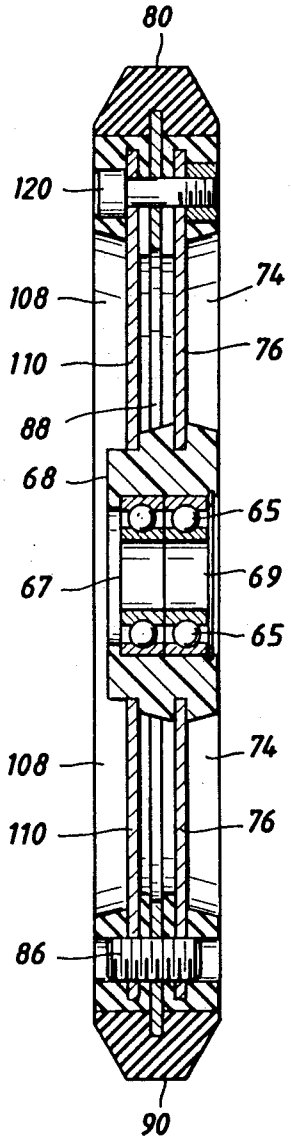
FIG. 6 is a right side view in partial cross section of the assembled roller guide tire assembly depicted in FIG. 4.
Figure 5:
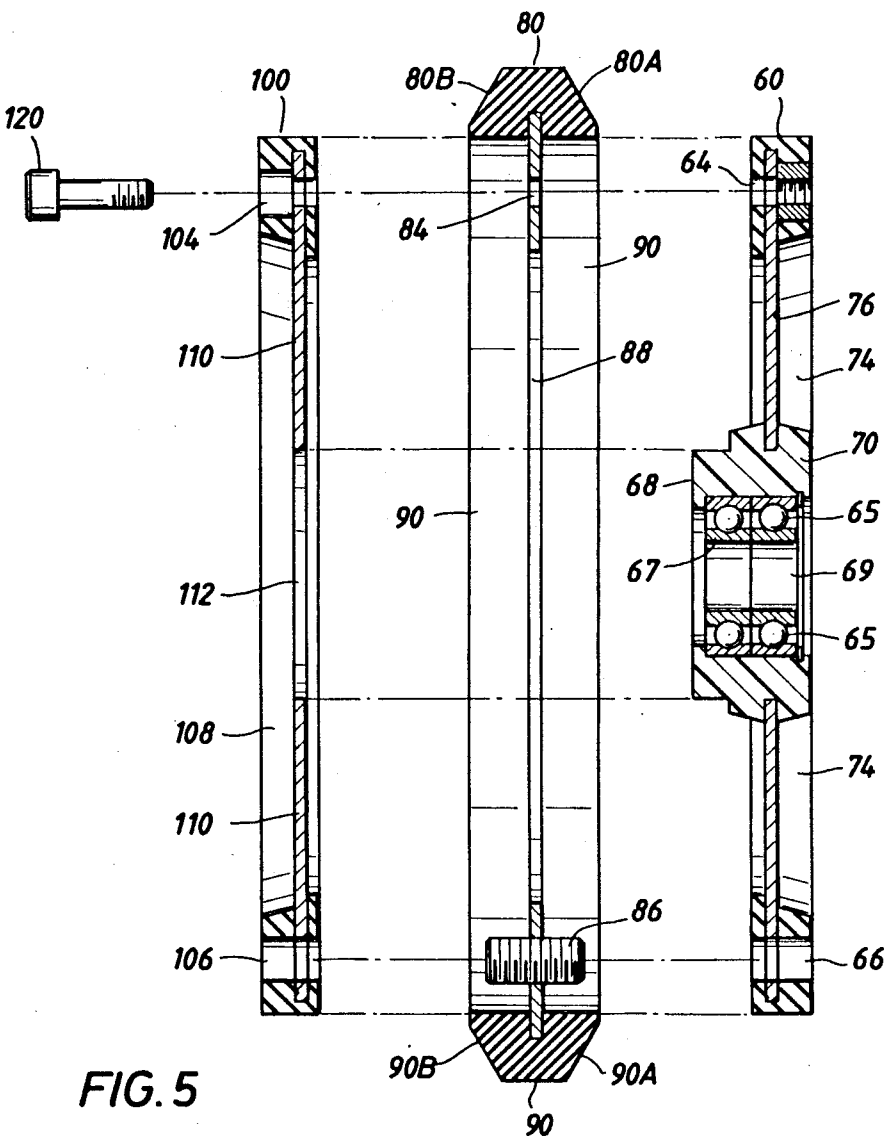
FIG. 5 is a right side view in partial cross section of the roller guide tire assembly depicted in FIG. 4.

Now referring to FIGS. 5 and 6, there may be seen right side views in partial cross section of the roller guide tire assembly depicted in FIG. 4, disengaged and engaged, respectively. Securement member 120 is shown in FIG. 5 being inserted into screw aperture 104 of flange plate 100, then into screw aperture 84 of tire plate 80, and finally into screw aperture 64 of hub plate 60. FIG. 6 shows securement member 120 securably inserted into corresponding screw apertures 104, 84 and 64. Similarly, FIG. 5 shows alignment pin 86 of tire plate 80 cooperating with alignment aperture 106 of flange plate 100 and alignment aperture 66 of hub plate 60. FIG. 6 shows how this alignment function accomplishes a secured joinder between these three portions of the tire assembly.

Now referring to FIG. 5, there are depicted chamfers 90 A-B and 80 A-B. These chamfers render the replaceable tire plate easier to handle, as well as enhance its aesthetic appeal.

An important feature of the present invention is the heretofore unknown ease with which the tire of the instant wheel assembly may be replaced. More particularly and as clearly shown in FIGS. 5 and 6, to replace tire plate portion 80, securement member 120 is unscrewed from interlocked screw apertures 104, 84 and 64, and the corresponding securement members are removed from interlocked apertures 103, 83 and 63, and 102, 82 and 62, respectively. Flange plate portion 100 is then removed, exposing the damaged tire plate portion 80. This tire plate portion is removed from hub plate portion 60, and replaced with another tire plate, using alignment pin 86 as a guide. Flange plate portion 100 is then engaged with the new tire plate portion using alignment pin 86 as a guide, thereby completing the servicing of the elevator car.

In accordance with the concept of the present invention, an elastomeric and preferably a polyurethane material is used for the rim portions of the removable roller guide tire assembly. As is well known to those knowledgeable in the urethane art, urethanes afford excellent wear resistance properties, and tend not to dissipate energy. They afford high tensile strength particularly at low temperatures, but these properties deteriorate at elevated temperatures. To avoid problems with heat buildup or flex stresses in the urethane, it is a feature of the present invention that a metal plate is preferably molded into each urethane component of the improved replaceable roller guide tire assembly. This also prevents a possible urethane shrinkage problem by enabling a tolerance of up to plus or minus five one thousandths of an inch diameter to be realized. As should be clear to those familiar with the art, such a tolerance is important to enable the alignment of the bolt circle on each of the three plates which comprise the roller guide tire assembly under the present invention. Without the molded metal plate the tolerance with urethane materials alone is typically about thirteen to fifteen thousandths of an inch diameter.

As is also known to those skilled in the urethane art, it is preferable to use a polyether-based urethane because polyester-based urethanes tend to be more susceptible to deterioration due to heat and moisture. For example, UniRoyal's Adiprene L83 is a preferable polyurethane prepolymer for producing polyurethane tires under the present invention. Of course, to achieve suitable characteristics of the polyurethane product, conventional cross-linking chemistry is invoked.

It should also be understood that it is within the teachings of the present invention that in applications where rubber is less susceptible to adverse environmental conditions than polyurethane, rubber tires should preferably be used. For instance, since polyurethanes are susceptible to deterioration in particularly humid conditions, Buna-N rubber tires would be preferable thereunder.

It should be clear that the removable roller guide tire assembly taught by the present invention virtually eliminates the problem of bond separation. Indeed, the present invention substitutes mechanical interconnection between the hub, tire and flange plate portions. There are no chemical bonds which can break during operation of the elevator car. Such concerns as misalignment, contaminated bonding, defective bonding, and even heat accumulation due to friction, are not pertinent to the normal operation of the present invention.

Under the concept of the present invention, the preferable material of construction for the rims of the flange plate and the hub plate is a 70 Shore D durometer polyurethane. The preferable material of construction for the rim of the replaceable tire plate is a 65 Shore A durometer polyurethane. As should be apparent to those skilled in the art, a softer polyurethane is preferred for the tire portion than is used for the hub and flange portions. This dual durometer matrix provides a tire assembly with an advantageous combination of wear and pressure resistance, and, of course, suitable rolling behavior.

As hereinbefore stated, it is an object of the present invention to provide an efficient and reliable method of servicing an elevator roller guide assembly. It should also be apparent that the present invention provides such an apparatus and method whereby the convenience afforded riders of an elevator is maintained while also increasing the reliability and safety of the elevator car.

Other variations and modifications will, of course, become apparent from a consideration of the structures and techniques hereinbefore described and depicted. Accordingly, it should be clearly understood that the present invention is not intended to be limited by the particular features and structures hereinbefore described and depicted in the accompanying drawings, but that the concept of the present invention is to be measured by the scope of the appended claims herein.

What is claimed is:

1. In a roller guide assembly with a shaft for moving an elevator car vertically in a hoistway along a pair of T-shaped guide rails, a wheel assembly comprising:

flange plate means;

tire plate means rollably engaging the surfaces of said T-shaped guide rails and releasably receiving said flange plate means;

hub plate means rotatably engaging said shaft and releasably receiving said tire plate means;

alignment means, disposed adjacent the proximal surfaces of said flange plate means and said tire plate means, and adjacent the proximal surfaces of said tire plate means and said hub plate means, for controlling said receiving of said flange plate means by said tire plate means and for controlling said receiving of said tire plate means by said hub plate means;

securing means for attaching said flange plate means to said tire plate means and for attaching said tire plate means to said hub plate means;

said tire plate means comprising a first annular metal plate fixedly imbedded into a first elastomeric rim;

said flange plate means comprising a second annular metal plate fixedly imbedded into a second elastomeric rim;

said hub plate means comprising:

a third annular metal plate fixedly imbedded into a third elastomeric rim;

ball bearing means disposed axially of said third annular metal plate and projecting perpendicularly therefrom; and shoulder means fixedly received by said ball bearing means and disposed concentrically thereof.

2. The apparatus described in claim 1 wherein said third elastomeric rim includes a polyurethane material.

3. The apparatus described in claim 1 wherein said: first elastomeric rim includes a polyurethane material.

4. The apparatus described in claim 1 wherein said elastomeric rim includes a polyurethane material.

5. In a roller guide assembly with a shaft for moving an elevator car vertically in a hoistway along a pair of T-shaped guide rails, a wheel assembly comprising:

flange plate means having a second annular metal plate fixedly imbedded into a second elastomeric rim;

tire plate means having a first annular metal plate fixedly imbedded into a first elastomeric rim, and rollably engaging the surfaces of said T-shaped guide rails and releasably receiving said flange plate means;

hub plate means comprising a third annular metal plate fixedly imbedded into a third elastomeric rim;

ball bearing means disposed axially of said third annular metal plate and projecting perpendicularly therefrom; and shoulder means fixedly received by said ball bearing means and disposed concentrically thereof; and rotatably engaging said shaft and releasably receiving said tire plate means;

alignment means comprising:

first alignment means disposed adjacent the proximal surfaces of said flange plate means and said tire plate means; and second alignment means disposed adjacent the proximal surfaces of said tire plate means and said hub plate means; and securing means for attaching said flange plate means to said tire plate means comprising:

a first plurality of screw apertures disposed perpendicularly in said tire plate means;

a corresponding second plurality of screw apertures disposed perpendicularly in said flange plate means; and a first plurality of bolts insertably and jointly received by said first plurality of screw apertures and by said second plurality of screw apertures.

* * * * *